US005896604A

United States Patent [19]

McLean

[11] Patent Number: 5,896,604

[45] Date of Patent: Apr. 27, 1999

[54] SUPPORT MODULE

[76] Inventor: Leslie Hylton McLean, 53 Sylvan Ridge Drive, Illawong, New South Wales, Australia, 2234

[21] Appl. No.: 09/002,615

[22] Filed: Jan. 5, 1998

[51] Int. Cl.[6] ..... A47C 23/04; A47C 27/04

[52] U.S. Cl. ..... 5/690; 5/697; 5/727; 297/284.1; 297/284.8

[58] Field of Search ..... 5/690, 697, 727; 297/284.8, 284.1

[56] References Cited

U.S. PATENT DOCUMENTS

| | | | |
|---|---|---|---|
| 2,545,310 | 3/1951 | Rosberger | 5/697 |
| 2,870,390 | 2/1959 | Stone | 5/697 |
| 3,252,170 | 5/1966 | Frye | 5/697 |
| 3,739,409 | 6/1973 | Johnson | 5/697 |
| 4,222,137 | 9/1980 | Usami | 5/697 |
| 4,677,701 | 7/1987 | Galumbrck | 5/697 |

*Primary Examiner*—Alex Grosz
*Attorney, Agent, or Firm*—Jacobson & Johnson

[57] ABSTRACT

There is a support module for a posture support device such as a bed mattress. The module comprises upper and lower frames (3A, 3B) connected together by linkages (3C, 3D) which in use of the module within the support device are adapted upon activation by an external control (3H, 3J) to displace the frames (3A, 3B) between a collapsed configuration and a spaced apart configuration so that the posture support device can be adjusted between a soft support and a firm support. The module may be fitted between rows of conventional innersprings during manufacture of a conventional bed mattress,

8 Claims, 4 Drawing Sheets

SUPPORT MODULE

FIELD OF INVENTION

This invention relates to posture supporting devices such as mattresses or the like. More particularly although not exclusively it discloses apparatus for selectively adjusting the degree of posture support available to the user.

BACKGROUND OF THE INVENTION

Existing mattresses are typically manufactured in "soft", "medium" and "firm" versions in accordance with the amount of support provided. The difference between the models is normally achieved by varying the type and number of innersprings as well as the thickness of the padding which is applied over them. While this initially provides the consumer with a choice, the available range of support is still limited. Also the support provided cannot be adjusted to suit particular areas of the body or different partners in the case of double beds. Further, with use, even firm mattresses begin to sag and lose their posture support and there is currently no way of readily compensating for this.

SUMMARY OF THE INVENTION

It is therefore an object of this invention to ameliorate the aforementioned disadvantages and accordingly a support module for a posture support device such as a bed mattress is disclosed said module comprising upper and lower frames connected together by linkages which in use of the module within said support device are adapted upon activation by an external control to displace said frames between a collapsed configuration and a spaced apart configuration so that said posture support device can be adjusted between a soft support and a firm support.

In another aspect this invention also discloses a posture support device such as a bed mattress in which one or more of said support modules are disposed respectively under one or more sections of said support device whereby said sections are selectively adjustable to provide posture support in accordance with the requirements of a user.

Preferably said one or more sections would include areas under the neck and shoulders, hips and buttocks or lower legs and feet of the user.

BRIEF DESCRIPTION OF THE DRAWINGS

The currently preferred embodiments of the invention will now be described with reference to the attached drawings in which.

DETAILED DESCRIPTION

Figure 1:
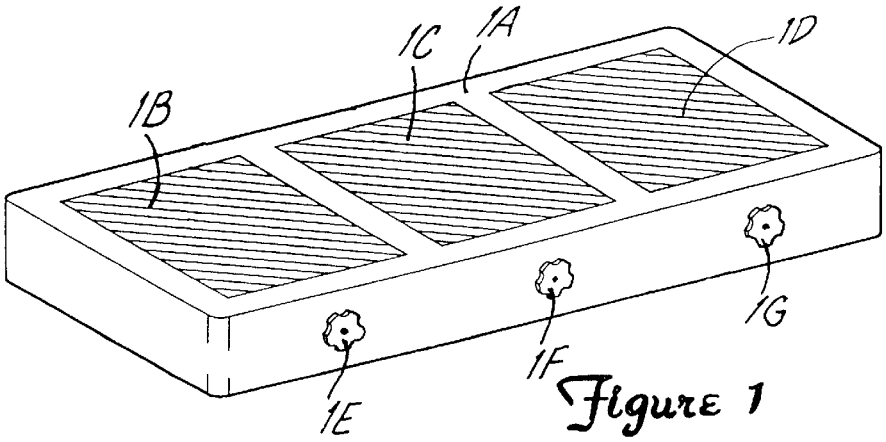
FIG. 1 is a schematic perspective view of a single bed mattress constructed according to this concept.

Referring first to FIG. 1 there is shown a single bed mattress. The upper surface 1A comprises three areas 1B, 1C and 1D shown diagramatically by shading. Each of these areas may be about 600×500 mm to support the parts of the user's anatomy referred to earlier. The invention however is not limited to these dimensions. Underneath each section and within the body of the mattress is a support module as described in more detail later. Each module is separately adjustable by a rotatable control knob 1E, 1F and 1G. Manipulation of these knobs by the user enables the different areas of the mattress indicated by the shading to be varied over a range of settings between "soft" support and "firm".

Figure 2:
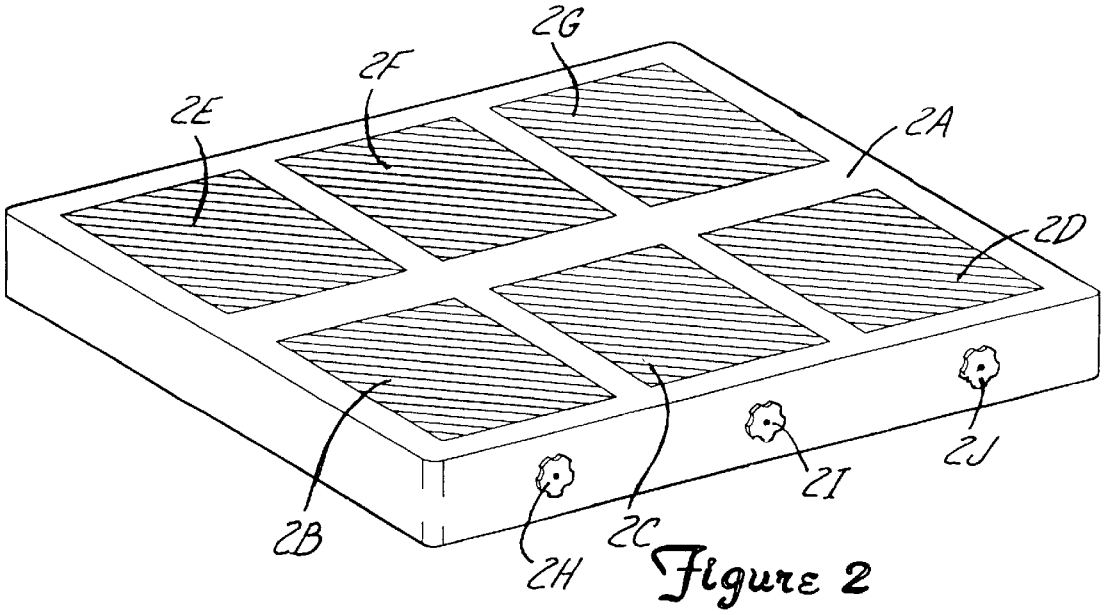
FIG. 2 is a schematic perspective view of a double bed mattress.

FIG. 2 shows a similar arrangement when applied to a double bed mattress. In this case the upper surface 2A has the three separately adjustable areas 2B, 2C, 2D, 2E, 2F and 2G for each partner. Although only one set of control knobs 2H, 2I and 2J is shown, an additional set is also located on the opposite side.

Figure 3:
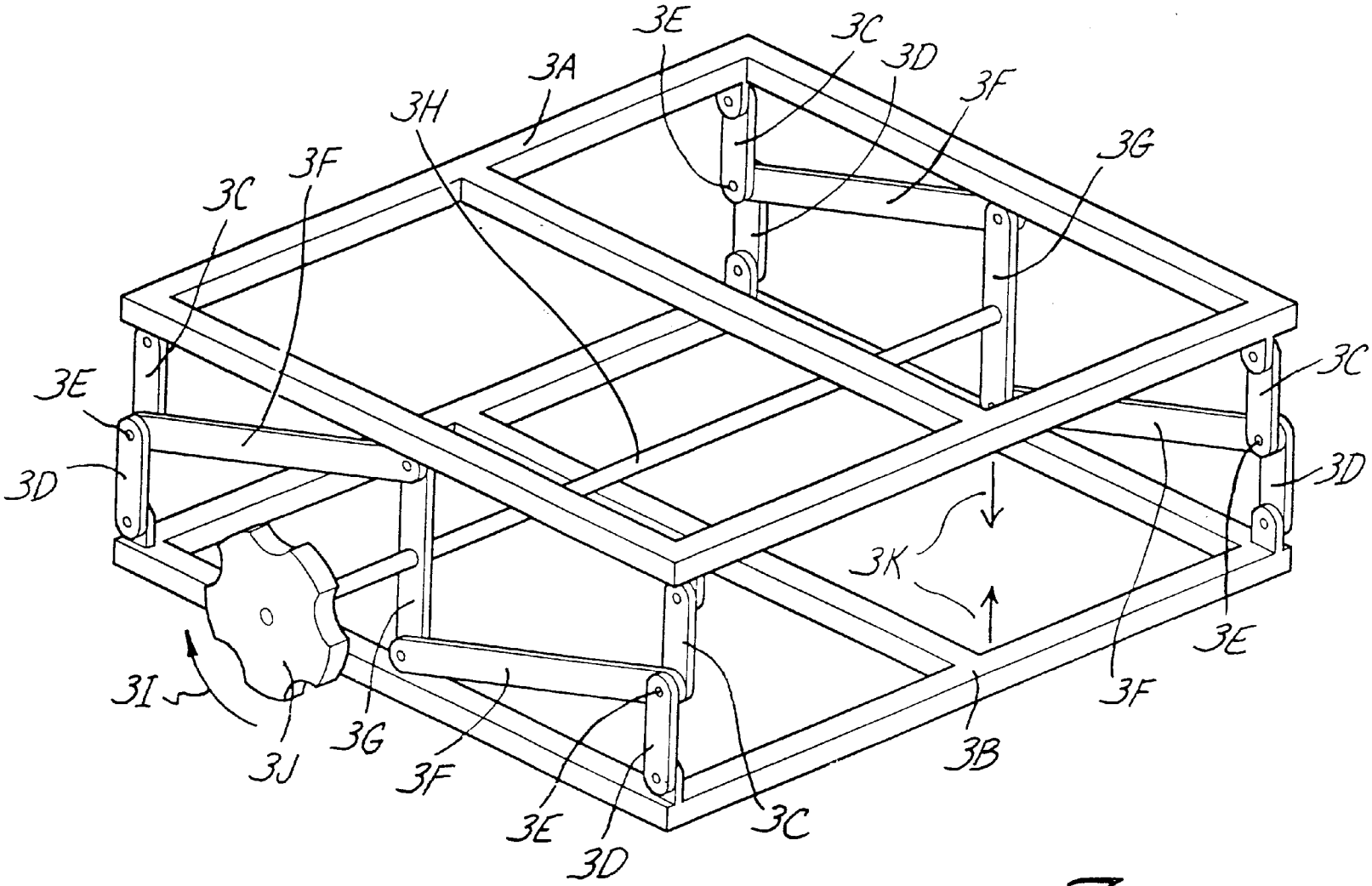
FIG. 3 is a schematic perspective view of the currently preferred form of adjustable support module.

As shown in FIG. 3 each of these support modules may comprise a set of parallel upper and lower rectangular frames 3A and 3B. These frames are connected together by a hinged end to end bar linkage 3C and 3D at each corner. The hinged center joints 3E at each corner are linked by additional bars 3F to the ends of central axle mounted crank arms 3G. As the axle 3H is rotated in the direction shown by arrow 3I using knob 3J the crank arms 3G turn to displace the hinged joints 3E inwardly. This serves to draw the frames together in the direction shown by arrows 3K. Preferably the axle and control knob are adapted to rotate in discrete increments to allow the frames to be set at any one of a range of positions between and including the collapsed ("soft") and fully expanded ("firm") configurations.

Figure 4:
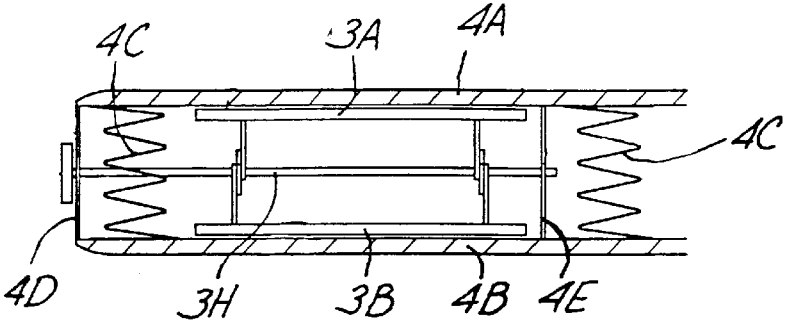
FIGS. 4, 5 and 6 show partial cross-sectional end and side views of an innerspring mattress with the module of FIG. 3 in side-by-side parallel relation to the springs.
Figure 5:
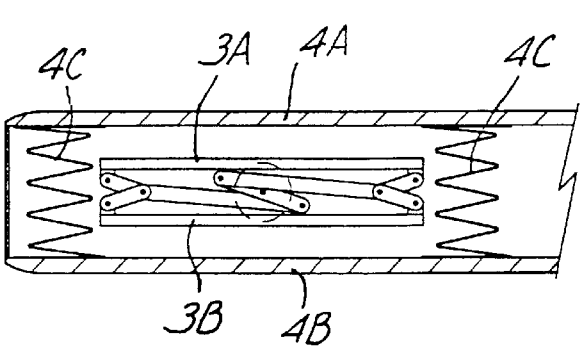
Figure 5:
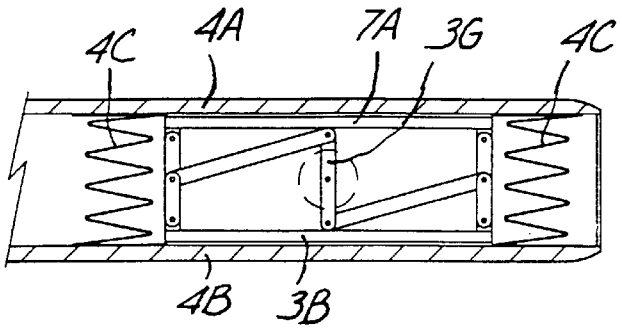
Figure 6:
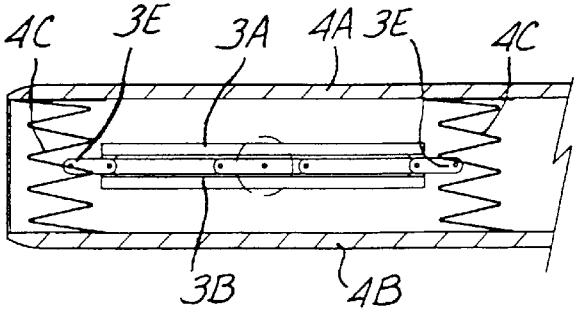

In accordance with one embodiment of this invention the module would be installed between the conventional rows of innersprings located within a mattress as shown in FIGS. 4, 5 and 6.

FIG. 4 shows a cross-sectional end view with the module frames 3A and 3B fully extended out to abut and support the upper and lower foam coverings 4A and 4B. In this configuration the module would firmly support the weight of a user and the springs 4C would be substantially inoperative.

FIG. 5 is a partial cross-sectional side view of the mattress of FIG. 4 in which the left end section as shown is adjusted for "medium" support by partially collapsing the frames 3A and 3B together as described earlier. By contrast the right end section is in the fully extended or "firm" configuration.

FIG. 6 shows another configuration for the module in which the frames are completely collapsed for "soft" support by rotating the axle 3H in the opposite direction to displace the joints 3E outwardly. In this case the innersprings 4C carry the majority of the user's weight.

As best shown in FIG. 4 each module is preferably supported about its axle 3H which passes through relatively stiff side walls and interior partitions 4D and 4E of the mattress.

Figure 7:
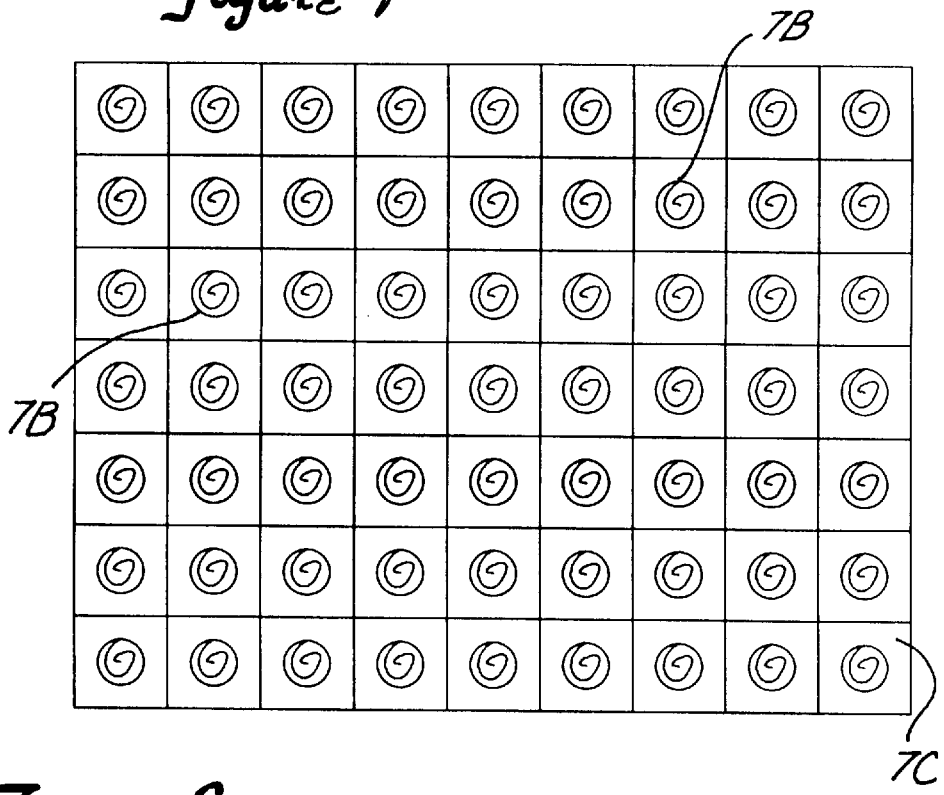
FIGS. 7 and 8 show plan and cross-sectional views of a second embodiment of the invention where the support module is located inside of or in tandem with the springs.
Figure 8:
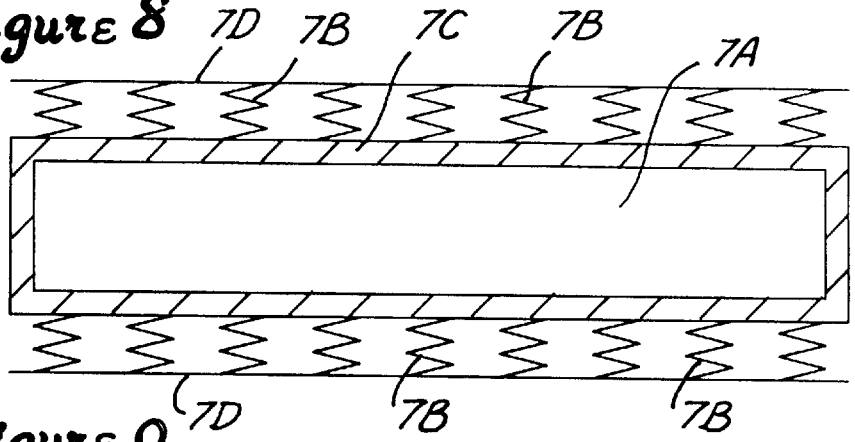

Another embodiment is shown in cross-sectional plan and side views in FIGS. 7 and 8. Here the module 7A is placed inside or in tandem with innersprings 7B which are disposed above and below. Solid platforms 7C of wood or other suitable material are fitted to the top and bottom frames of the module. The inner springs 7B then extend between these platforms and the upper and lower support surfaces 7D of the mattress. As a modification to this embodiment the springs may be replaced with additional layers of foam 7E above and below the module as shown in FIG. 9.

Figure 9:
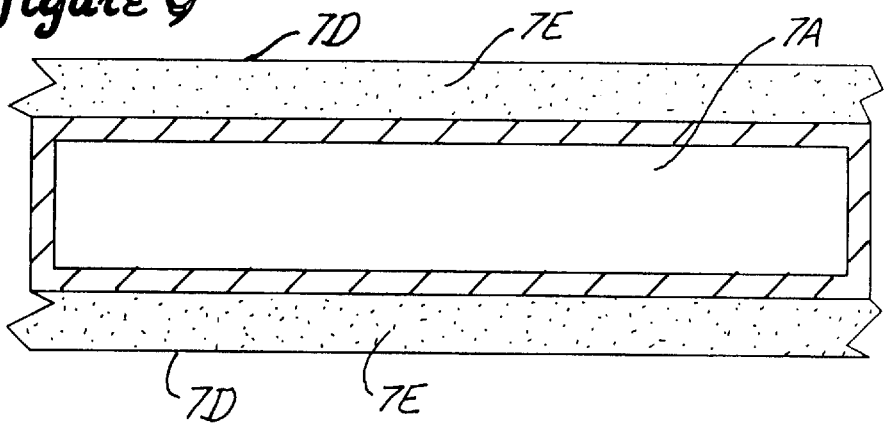
FIG. 9 shows a cross-sectional view of a modification to the embodiment of FIGS. 7 and 8 where foam is used in place of the springs.

It is considered that the embodiment shown in FIGS. 7, 8 and 9 would be easier and cheaper to assemble as the fitting and securing of the modules between the rows of innersprings required with the earlier embodiments would be avoided.

It will also be noted that the module disclosed is preferably symmetrical about its horizontal center plane so that both the top and bottom frames move apart and retract equally. Thus, with each of the aforementioned embodiments the mattress can be turned over or turned end for end and the modules simply reset to the desired level of firmness.

For the purposes of this specification expressions such as "upper" and "lower" refer to the module and mattress in a position of use as illustrated and are not to be read as necessarily limiting.

It will thus be appreciated that this invention at least in the form of the embodiments disclosed provides a novel and useful improvement to mattresses and other posture supporting devices. Clearly however the examples described are only the currently preferred forms of this invention and a wide variety of modifications may be made which would be apparent to a person skilled in the art. For example, the mechanism used to adjust the modules may be changed according to application. Also, while it is currently proposed to construct the modules from metal any other suitably strong material may be used.

The claims defining the invention are as follows:

1. A support module for a posture support device such as a bed mattress, said module comprising upper and lower frames connected together by hinged end to end links, the center joints of said links being connected by bars to an axle mounted crank arm mechanism whereby in use of the module within said support device said axle may be rotated in discrete increments by external handle means to move said center joints in a manner to displace said frames to any one of a number of positions between a collapsed configuration and a spaced apart configuration so that said posture support device can thereby be adjusted between a soft support and a firm support in accordance with the requirements of a user.

2. A posture support device such as a bed mattress in which at least one support module as claimed in claim 1 is disposed under a section of said device whereby said section is selectively adjustable to provide posture support in accordance with the requirements of a user.

3. The posture support device as claimed in claim 2 wherein said section includes an area which in use is under the user's neck and shoulders hips and buttocks or lower legs and feet.

4. The posture support device as claimed in claim 2 wherein there are a plurality of support modules under respective sections of said posture support device which are separately adjustable by means of an external control.

5. The posture support device as claimed in claim 4 wherein said support modules are adjustable by means of respective rotatable axles extending out through the sides of said support device.

6. The posture support device as claimed in claim 2 wherein said at least one module is located between rows of innersprings within said support device.

7. The posture support device as claimed in claim 2 wherein said at least one module is positioned such that innersprings of said device are located between said upper and lower frames of the module and the outer covering of said posture support device.

8. The posture support device as claimed in claim 2 wherein said at least one module is positioned such that resiliently deformable padding is located between said upper and lower frames and the outer covering of said posture support device.

* * * * *